US005709259A

United States Patent [19]

Lewis et al.

[11] Patent Number: 5,709,259

[45] Date of Patent: *Jan. 20, 1998

[54] MULTIPLE SECTION MODULAR DOOR AND JOINT STRUCTURE

[75] Inventors: Richard J. Lewis, Loveland; Bobby G. Bailey, Trenton; Alan R. Leist, Cincinnati; Frank R. Wilgus, Powell; Frank A. Wilgus, Jr., Westerville, all of Ohio

[73] Assignee: Clopay Building Products Company, Inc., Cincinnati, Ohio

[ * ] Notice: The term of this patent shall not extend beyond the expiration date of Pat. No. 5,626,176.

[21] Appl. No.: 509,955

[22] Filed: Aug. 1, 1995

Related U.S. Application Data

[63] Continuation of Ser. No. 435,887, May 5, 1995, abandoned.

[51] Int. Cl.[6] ..... E05D 15/16

[52] U.S. Cl. ..... 160/201; 160/236

[58] Field of Search ..... 160/201, 229.1, 160/235, 236, 232; 52/458, 455, 314, 311.2

[56] References Cited

U.S. PATENT DOCUMENTS

| | | | |
|---|---|---|---|
| 2,311,470 | 2/1943 | Ritter | 160/201 |
| 2,880,796 | 4/1959 | Stroup | 160/235 X |
| 2,951,533 | 9/1960 | Lucas et al. | 160/201 X |
| 2,952,313 | 9/1960 | Stroup | 160/229.1 X |
| 3,178,776 | 4/1965 | Stansberry . | |
| 3,359,594 | 12/1967 | Pastoor | 160/235 |
| 3,570,579 | 3/1971 | Matsushima | 160/235 |
| 4,518,026 | 5/1985 | Otto et al. . | |
| 4,828,004 | 5/1989 | Martinez et al. . | |
| 4,893,666 | 1/1990 | Hörmann . | |
| 4,963,407 | 10/1990 | Detweiler et al. . | |
| 4,989,660 | 2/1991 | Wagner . | |
| 5,016,700 | 5/1991 | Wegner et al. . | |
| 5,060,711 | 10/1991 | Fimbell, III . | |
| 5,123,211 | 6/1992 | Schlicht et al. . | |
| 5,129,441 | 7/1992 | Leist et al. . | |
| 5,131,199 | 7/1992 | Clark . | |
| 5,148,850 | 9/1992 | Urbanick . | |
| 5,163,493 | 11/1992 | Kraeutler | 160/201 |
| 5,168,915 | 12/1992 | Lafleur . | |
| 5,333,428 | 8/1994 | Taylor et al. . | |

*Primary Examiner*—Blair Johnson
*Attorney, Agent, or Firm*—Wood, Herron and Evans, L.L.P.

[57] ABSTRACT

A multiple section door system, such as an overhead residential garage door, wherein a variety of different door front configurations are formed with a limited number of panel designs by flipping or turning at least one panel relative to an adjacent panel. Each panel includes identical structured joint members along two longitudinal edges thereof which enable one panel to be "flipped" or turned such that the lower edge becomes the upper edge and vice versa, while an adjacent panel may remain in its original orientation. A third structured joint member is connected between the two adjacent joint members of adjacent panels. The third structured joint member is a male member, while the two structured joint members attached to each panel are female members. Adjacent female joint members of two panels form a universal pinch resistant joint with the male joint member.

21 Claims, 6 Drawing Sheets

MULTIPLE SECTION MODULAR DOOR AND JOINT STRUCTURE

This is a continuation of application Ser. No. 08/435,887, filed May 5, 1995, abandoned.

This application is related to co-pending and commonly assigned U.S. patent application Ser. No. 08/435,796, filed concurrently herewith, abandoned.

BACKGROUND OF THE INVENTION

The present invention generally relates to a multiple section or multiple panel door and, more specifically, to a multiple section overhead door.

Overhead doors, such as residential garage doors, are generally constructed with a plurality of elongated panel sections hinged together along adjacent longitudinal edges. The door is supported for movement between open and closed positions by rollers contained with tracks mounted generally adjacent the door opening. One area which has been a concern with respect to such doors is the "pinch zone" formed at the joints between adjacent panels. As the door is raised or lowered, many joint designs allow a space to open up on the outside of the door between two adjacent panels as one of the panel angles with respect to the other. This space closes as the adjacent panels move into alignment and, if a person's finger or fingers are in the space, a potentially serious pinch can occur.

Many overhead or sectional doors have been proposed which have one type of "pinch resistant" joint construction or another. While these joint constructions may be at least partially successful at preventing injury to fingers, etc., being caught in the joint, they have also presented several drawbacks. Namely, many of the proposed and implemented pinch resistant joint constructions are complicated structures which have relatively costly components and which are rather difficult and labor intensive to manufacture and assemble.

Another drawback of overhead doors is the high cost associated with producing doors having differently designed or configured front surfaces. This is especially true of residential garage doors which can greatly affect the look of a house. Often, the garage doors of houses in large neighborhoods or developments have the same design or one of only a very limited choice of designs. This is largely due to the high cost of manufacturing and stocking overhead sectional doors having a large number of different designs from which home builders may choose when designing and building a house. That is, to reduce manufacturing costs, a large quantity of very limited styles of overhead doors are made and stocked rather than a large number of styles being manufactured in limited quantities. Home builders and other consumers in the market for a new overhead door therefore find it difficult to easily or inexpensively lend a unique look to their home by way of a garage door front having a different aesthetic look than all or most of the remaining homes in the neighborhood.

Past multiple section doors having structured joint portions along the longitudinal edges thereof must be assembled in a particular orientation. Each longitudinal edge is typically either a "female" member or a "male" member, or a dedicated rabbet joint, which will not allow one panel to be turned or flipped without also flipping the adjacent panel or panels to align the complementary joint members. This is also an impediment to providing modularity and variety to the outside surface design of the door and increases costs. Typically, the "male" portion of the joint must be oriented in an upward direction to prevent water from infiltrating the joint.

In view of the above problems and drawbacks of existing overhead doors, it would be desirable to provide an overhead door which is both pinch resistant and relatively easy to manufacture and assemble, and which is designed as part of a modular door system enabling a wide variety of unique door front styles to be assembled easily and inexpensively.

SUMMARY OF THE INVENTION

The present invention is embodied in a multiple section door system, such as an overhead residential garage door, wherein a variety of different door front configurations or designs are formed with a limited number of panel designs by flipping or turning at least one panel relative to an adjacent panel. Specifically, each panel includes identical structured joint members along two longitudinal edges thereof which enable one panel to be "flipped" or turned such that the lower edge becomes the upper edge and vice versa, while an adjacent panel may remain in its original orientation. The joint members along each longitudinal edge of each panel are therefore "universal" in the sense that they may function either as a relative upper edge or a lower edge of a panel, regardless of the orientation of the adjacent panel or panels. A third structured joint member is connected between the two adjacent joint members of adjacent panels. This third structured joint member is preferably a male member, while the two structured joint members attached to each panel are female members. Together, adjacent female joint members of two panels form a universal pinch resistant joint with the male joint member and further present a neat closed seam line between adjacent panels.

Although other materials and manufacturing methods may be used, the structured female joint members are preferably formed from extruded, continuous plastic rails connected along the entire length of both longitudinal edges of each panel. Each of these rails present a continuously curved bearing or joint surface which mates with a complementary curved surface of the male joint member. To provide "pinch resistance", the curved surface of the male joint member is exposed at the joint when adjacent panels are pivoted about the joint. These mating surfaces substantially prevent significant spaces from opening up as the panels pivot relative to one another and thereby help to create a pinch resistant joint. A flexible, continuous hinge is connected along the rear of each joint to assist in preventing pinching from the rear and to weatherproof the joint.

The door panels are formed with inner and outer skins sandwiching a foam core as well as the female structured joint members between them. Each female joint member further includes a cavity for receiving an elongate reinforcing strut to provide structural rigidity to the panel. A universal end stile or cover plate and roller assembly generally complete the construction of the door. Finally, a universal seal member or astragal is provided which easily connects with the lowermost female structured joint member of the lowest panel in a particular door configuration. As all of the female structured joint members are identical, the astragal may be quickly connected to the lower edge of the door no matter what panel is used as the lowermost panel and regardless of the orientation of that panel.

Door panels are also provided in accordance with the present invention having front design patterns which will give the panel a different aesthetic "look" depending on whether a panel or panels are connected in one orientation or another, flipped over orientation. The provision of a "universal" joint, or a joint allowing one panel to be flipped over with respect to the other therefore enables a versatile, aesthetically variable door system to be manufactured much more cost efficiently than in the past as door panel styles may be made in relatively limited varieties, and connected together in different configurations.

At least one panel includes design elements which are asymmetrical about a longitudinal center line of the panel such that a first design pattern is presented when the panel is oriented one way and a second, differently configured design pattern is presented when the panel is flipped such that an upper edge becomes a lower edge and a lower edge becomes an upper edge. In each of the two orientations, the asymmetrical design elements align with design elements of at least one other panel in the door to create a different overall look or design pattern.

Further advantages of the present invention will become more apparent upon review of the following detailed description of a preferred embodiment thereof, taken in conjunction with the accompanying drawings

DETAILED DESCRIPTION OF THE PREFERRED EMBODIMENT

Figure 1:
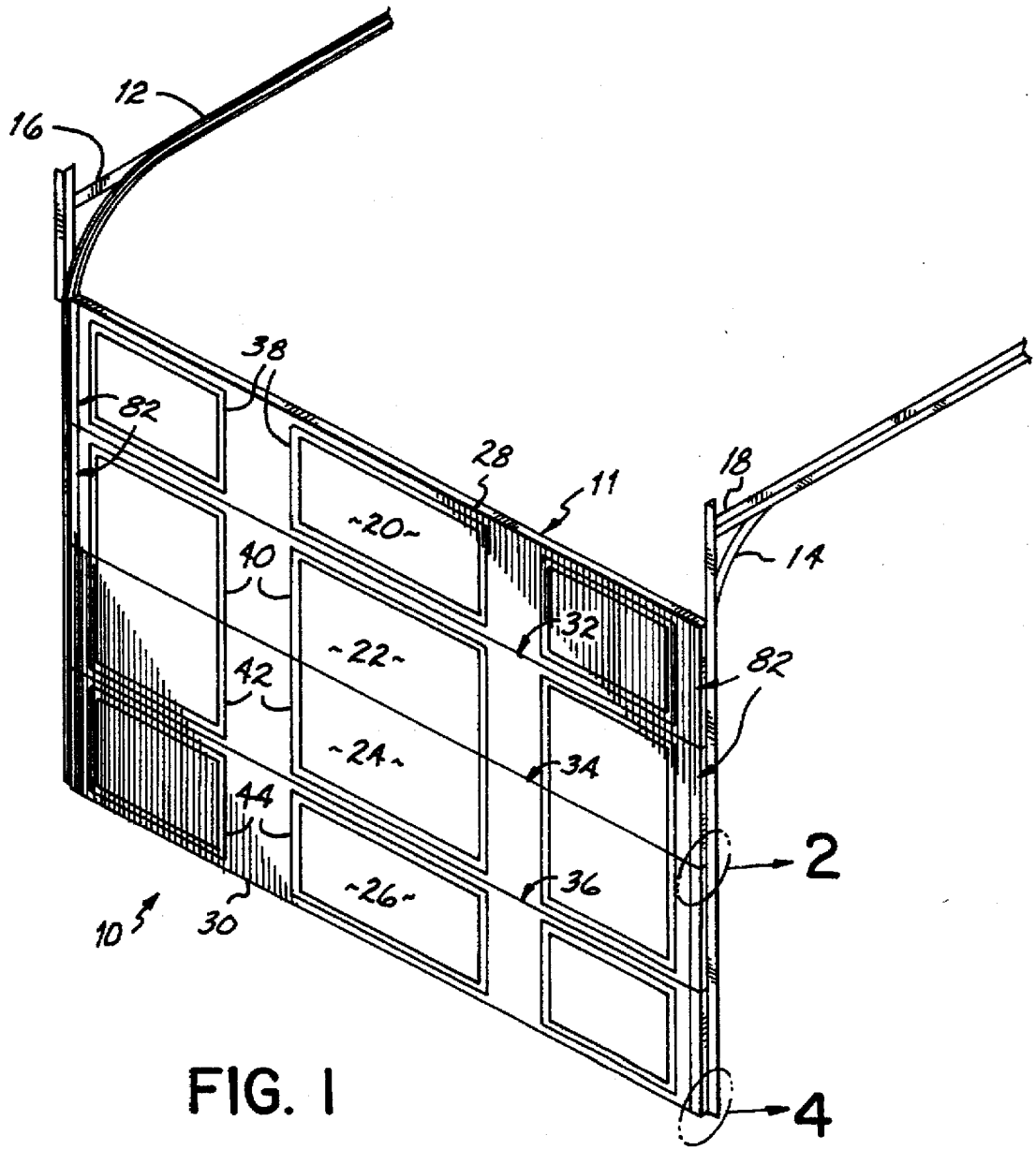
FIG. 1 is a schematic perspective view of an overhead door system which is constructed in accordance with the preferred embodiments of this invention.

Referring first to FIG. 1, an overhead door system 10 is schematically illustrated and generally comprises a sectional door 11 movable between a raised open position and a closed position, as shown, while supported for movement along tracks 12, 14. As is conventional, tracks 12, 14 are mounted to suitable frame structure 16, 18. For clarity, the remaining structure typically associated with overhead door system 10, such as a counterbalancing system, opener mechanism and other building structure, has been left off FIG. 1 since such structure is well known and not necessary for purposes of understanding the present invention.

Sectional door 10 is preferably comprised of a plurality of four door panels 20, 22, 24, 26, although other numbers of panels may be used as well. Door 10 includes an upper edge 28 which is the upper edge of panel 20 and a lower edge 30 which is the lower edge of panel 26. Adjacent panels are connected for hinged movement relative to each other by joints 32, 34, 36 and the front face of each panel 20, 22, 24, 26 presents a respective design pattern 38, 40, 42, 44. Design patterns 38, 40, 42, 44 may be formed in various manners, such as by the use of raised mullions, molded decorative front panel surfaces or other markings. They may, of course, be more intricate or elaborate than the simple designs 38, 40, 42, 44 shown in the drawings.

As further shown in FIG. 1, the design patterns 38, 40, 42, 44 align with each other to form an overall front surface design for door 11. It will be appreciated that panels 22, 24 are identical, however, design patterns 40, 42 have different aesthetic looks because of their opposite orientations. One panel 22 or 24 has been flipped or turned around with respect to the other panel to present an aligned pattern as between the two panels 22, 24. In accordance with the present invention, and as will be further detailed below, panels 38, 40, 42, 44 are part of a versatile modular panel system from which a variety of sectional door front designs may be constructed from a limited number of panel front design styles or types.

Figure 2:
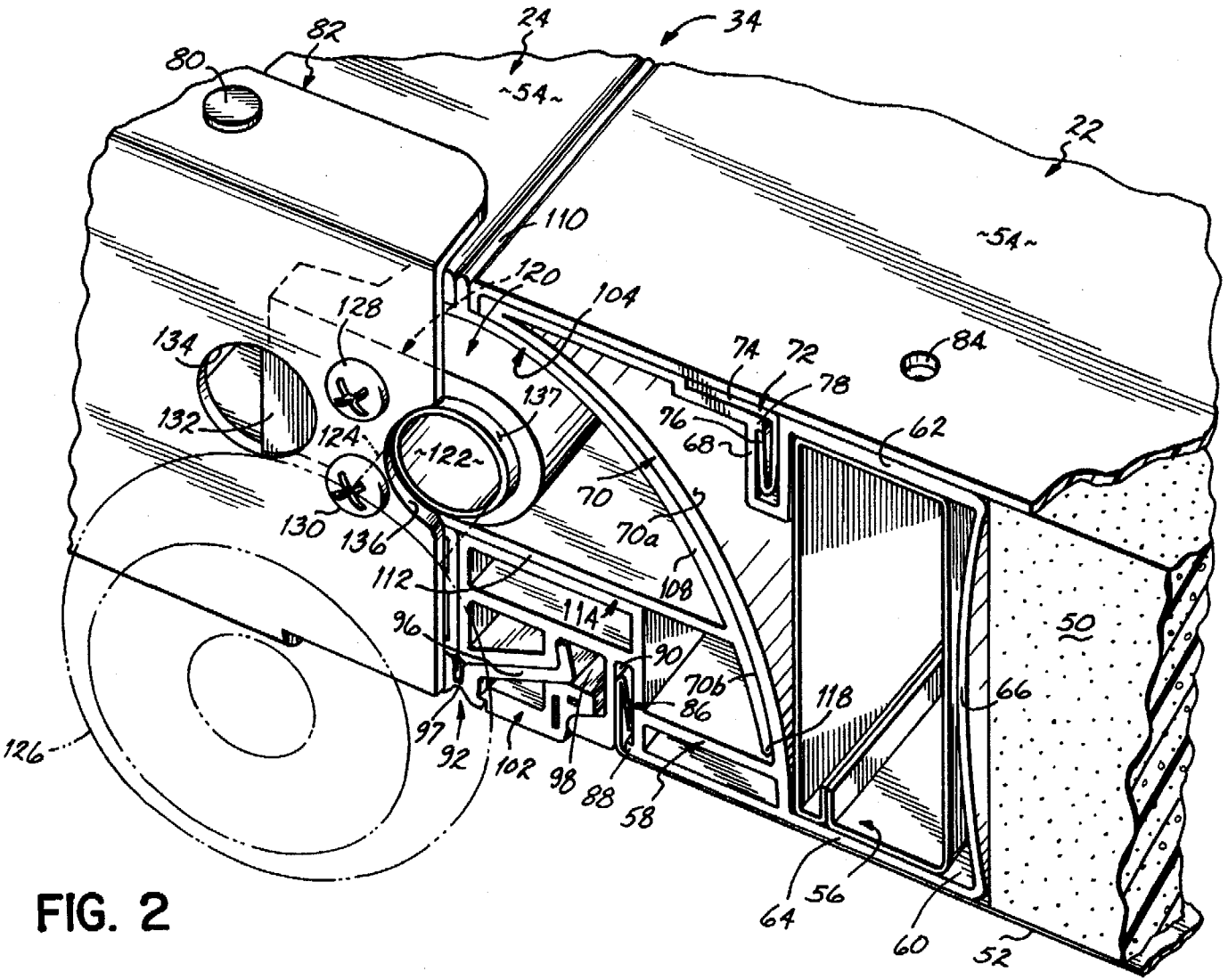
FIG. 2 is an enlarged perspective view of the preferred joint construction between adjacent panels taken generally from the encircled portion 2 of FIG. 1 but with one end stile or cover removed and the door supporting track removed for clarity.
Figure 3:
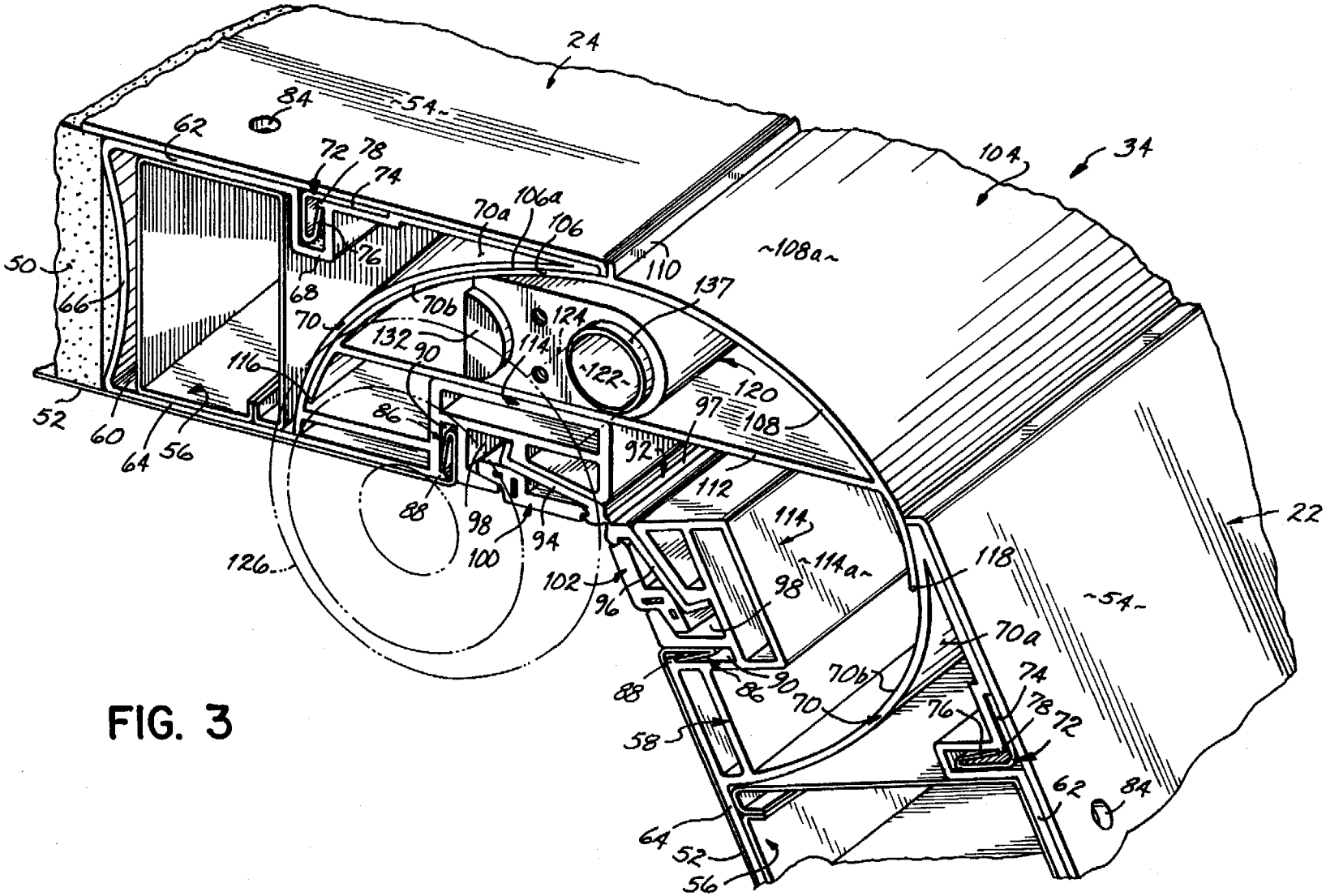
FIG. 3 is a perspective view of the preferred joint shown in FIG. 2, but with the adjacent panels angled as during a door opening or closing operation.

Referring now to FIGS. 2 and 3, the construction of joint 34 and adjacent panels 22 and 24 are shown in detail. As joints 32 and 36 are identical to joint 34 and panels 22 and 24 are also comprised of structural components identical to panels 20 and 26, the following description as to such common structure applies to all three joints 32, 34, 36 and four panels 20, 22, 24, 26 of door 11. With regard to panels 22, 24 specifically shown, each is comprised of a foam core 50 having sheet material or "skins" 52, 54 bonded to each side. Skins 52, 54 may be formed of many types of materials, but in the preferred embodiment inner skin 52 is a thin sheet metal skin and outer skin 54 is a thicker polymeric skin which may be formed or molded with an outer decorative appearance. Metal supporting struts 56 are disposed between skins 52, 54 and extend lengthwise adjacent each side of joint 34 to lend structural support to panels 22, 24. As each panel 20, 22, 24, 26 is structurally identical, it will be understood that each longitudinal edge of each panel 20, 22, 24, 26 includes a strut 56 and that each panel 20, 22, 24, 26 therefore is provided with structural rigidity adjacent each side edge of foam core 50.

Each panel 22, 24 further includes a female structured joint member 58 extending continuously with the same cross sectional shape along the length of each longitudinal edge. Structured joint member 58 is preferably extruded from a polymeric material such as polyvinyl chloride. Support strut 56 is preferably contained within a cavity 60 of joint member 58 defined between side walls 62, 64, end wall 66, a clip holder 68 and the outer surface 70*a* of a continuously curved joint wall 70. It is contemplated, however, that cavity 60 could simply comprise the space between skins 52, 54, foam core 50 and joint wall 70 and not be defined within joint member 58. Clip holder 68 retains a clip 72 therein with a snap fit. In this regard, clip 72 is generally "L"-shaped and includes a first leg 74 bonded, such as by adhesive, to the inner surface of outer skin 54 and includes a second leg 76 in the form of a spring clip which is retained within clip holder 68 by leg 76 being held against projection 78. Clip 72 is optional but may be used to help hold outer skin 54 to structured joint member 58 in addition to adhesive bonding which is preferably also provided therebetween. Further mechanical connections are provided by rivets 80 extending through angled metal end stiles 82 in each panel (one of each being shown in FIG. 2), and further extending through a hole 84 in outer skin 54, and through wall 62 and strut 56. Also, inner skin 52 includes a spring clip 86 formed along each longitudinal edge which is retained by a projection 88 within a clip holding cavity 90 of structured joint member 58.

As best illustrated in FIG. 3, structured joint members 58 of adjacent panels 22, 24 are fastened together by a hinge 92 which preferably comprises an elongate flexible hinge as generally disclosed in U.S. Pat. No. 5,054,536, which is commonly assigned with the present application to Clopay Corporation located in Cincinnati, Ohio, and the disclosure of which is hereby incorporated by reference in its entirety. Elongate flexible hinge 92 generally includes two solid, flexible hinge portions 94, 96 connected along a hinge line 97 and each retained within a retaining cavity 98 of a respective joint member 58 by separate elongate retaining slats 100, 102.

As also shown in FIGS. 2 and 3, joint 34 and the connection between panels 22, 24 is also formed with a third elongate intermediate joint member 104 extending along the length of each panel 22, 24 and having a continuous cross sectional shape as shown. Like joint members 58, joint member 104 may be extruded from a polymeric material such as polyvinyl chloride. Joint member 104 is a male joint member which is generally "D"-shaped in cross section and includes continuously curved joint elements 106, 108 having concave outer surfaces 106*a*, 108*a* with a continuous straight rib 110 extending outwardly from a centerline between surfaces 106*a*, 108*a*. Rib 110 generally defines the joint line on the outside of door 11 between panels 22, 24. Rib 110 also provides a stop element for adjacent edges of panels 22, 24. Rib 110 preferably extends outwardly about 3/16 inches from surfaces 106*a*, 108*a* and is preferably formed from a softer, more resilient material that the remainder of joint member 104, It may, for example, simply be a softer form of polyvinyl chloride.

As best illustrated in FIG. 3, joint member 104 further includes a flat support plate 112 connected across the convex sides of elements 106, 108. Support plate 112 not only provides structural rigidity to joint member 104 but acts as a stop against surfaces 114*a* of joint support portions 114 formed in each of the adjacent female structure joint members 58 of panels 22, 24. The ends 116, 118 of elements 106, 108 extend past flat support plate 112. Each curved joint element 106, 108 has a length defined between rib 110 and respective ends 116, 118 such that during the normal operation of door 11 the maximum angle between panels 22, 24 will not cause either element 106 or element 108 to become dislodged from their respective female joint members 58. It will be appreciated that as panels 22, 24 angle with respect to one another as shown in FIG. 3, outer curved bearing surfaces 106*a*, 108*a* of curved male joint elements 106, 108 will bear and slide against complementary inner bearings surfaces 70*b* of the respective female joint members 58. Engagement of the relatively large surfaces 106*a*, 108*a* with complementary surfaces 70*b* of joint members 58 provides for a strong weatherproof joint. In addition, it will be appreciated that no deep open spaces are created as pinch zones.

Referring again to both FIGS. 2 and 3, a roller support 120 is provided and preferably disposed within the space created between support plate 112 and elements 106, 108. This roller support 120 includes a bore 122 for receiving the shaft 124 of a roller 126. As specifically shown in FIG. 2, a pair of screw fasteners 128, 130 are used to affix roller support 120 to end stile or cover plate 82. A semicircular locator element 132 is also provided on roller support 120 for locating roller support 120 and end stile 82 with respect to each other by being received within a hole 134 of end stile 82. End stile 82 further includes a curved notch 136 in the end thereof for receiving a portion of a peripheral lip 137 defining bore 122 of roller support 120. This overall construction allows roller 126 to be mounted with its axis of rotation at least substantially in line and parallel with hinge line 97 of hinge 92. It will also be appreciated that end stile 82 has exactly the same design at each end thereof, such that it may be used on either end of a panel 20, 22, 24, 26.

Figure 4:
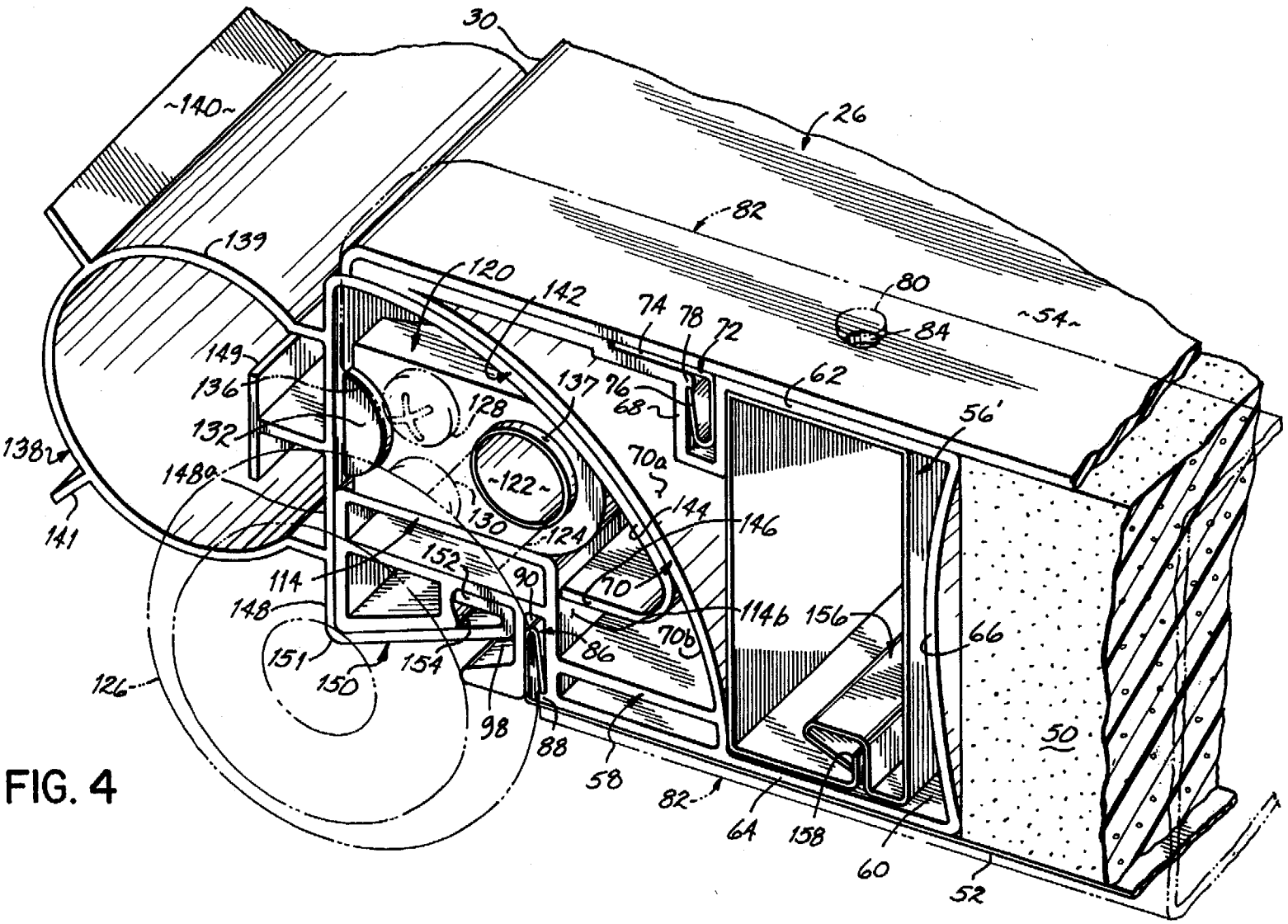
FIG. 4 is an enlarged perspective view of the bottom edge of the lower panel taken generally from the encircled portion 4 in FIG. 1 but with the end stile or cover and door supporting track removed for clarity.

FIG. 4 illustrates the unique construction and modular nature of panels 20, 22, 24, 26 with respect to their universal ability to allow easy and quick connection of a weather-tight seal to lower edge 30 of door 11 (FIG. 1) no matter which one happens to be the lowermost panel. Specifically, referring to FIG. 4, a seal member or astragal 138 is provided with a construction which allows easy connection thereof to female joint member 58, in this instance, of panel 26. It will be appreciated, however, depending on the arrangements of various panels 20, 22, 24, 26 of door 11, that astragal 138 may be attached to any of the relative upper or lower longitudinal edges of each of these panels 20, 22, 24, 26. The construction of female joint member 58 and panel 26 as shown in FIG. 4, are identical to the construction described with respect to panels 22, 24 and female joint members 58 shown in FIGS. 2 and 3, except for the provision of an alternative embodiment to support strut 56 which will be described below. For an understanding of the remaining structure of panel 26 and female joint member 58 shown in FIG. 4, the description with respect to FIGS. 2 and 3 above may be relied upon.

Astragal 138 generally comprises a tubular resilient cylindrical member 139 having a pair of seal strips 140, 141 extending outwardly therefrom and generally defining the lowermost edge of door 11 for providing a ground seal when door 11 is in the closed position (FIG. 1). Astragal 138 is preferably extruded in one elongate integral piece from a sufficiently resilient polymeric material, such as a soft or flexible polyvinyl chloride, and includes a male connecting member 142 as an integral portion thereof. Male connecting member 142 includes a curved element 144 having generally the same shape as curved portions 106, 108 of male joint member 104 described above, such that it follows and preferably bears against inner curved surface 70*b* of curved joint wall 70 in female joint member 58. Curved element 144 ends at a clip portion 146 which is retained against an end wall 114*b* of joint support 114. Connecting member 142 further includes a straight, flat end 148 having a stop member 149 extending from an outside surface 148*a*, and an angled clip portion 150 extending inwardly from an edge 151. Angled portion 150 includes a clip 152 at the inner end thereof which is received within cavity 98 of female joint member 58 and which bears against a wall 154 therein. It will be appreciated that connecting member 142 is simply snapped into place generally from left to right as viewed in FIG. 4, and connecting member 142 is thereby restrained from movement back out of joint member 58 by clips 146 and 152.

Finally, as also illustrated in FIG. 4, an alternative reinforcing strut 56' is shown. Reinforcing strut 56' is generally formed by bending a flat sheet of steel into a generally rectangular tubular shape as in the first embodiment, however, a positive manner of retaining that shape is provided to strut 56' by a clip 156 formed by appropriately bending one edge of the steel sheet that forms strut 56'. Clip edge 156 allows strut 56' to be formed by bending a flat steel sheet generally in the shape shown and then squeezing strut 56' together such that clip edge 156 engages projecting edge 158 to positively retain strut 56' in a rectangular tubular shape for easy insertion into cavity 60 of female joint member 58.

Figure 5A:
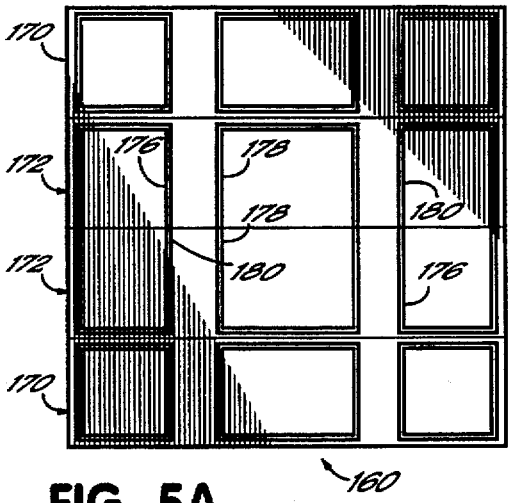
FIGS. 5A–5E are front elevational views of five different aligned door front configurations which may be constructed from three different door panel styles; and, FIGS. 6A–6C are front elevational views of three different aligned door front configurations which may be constructed from two different door panel styles.
Figure 5B:
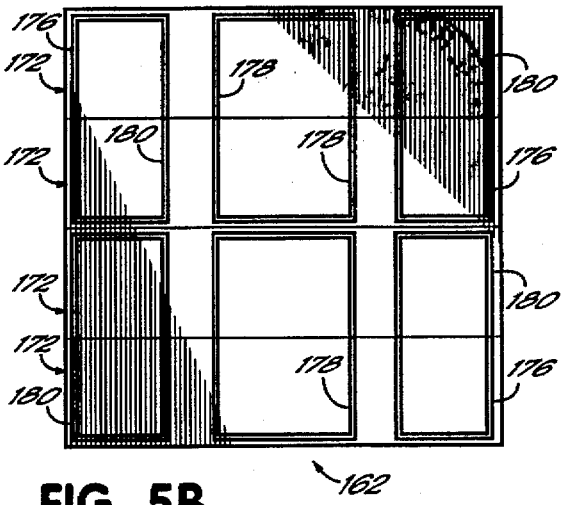
Figure 5C:
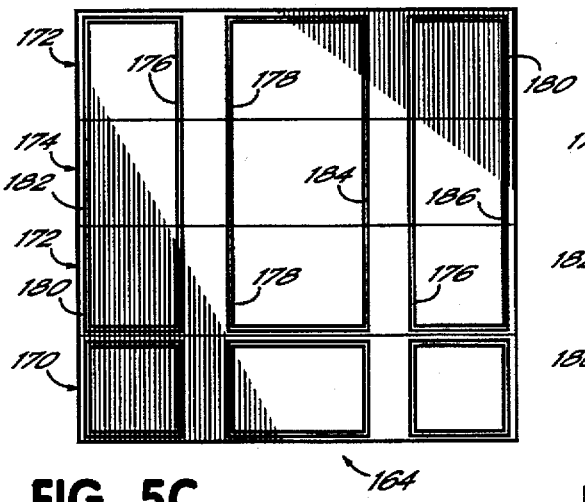
Figure 5D:
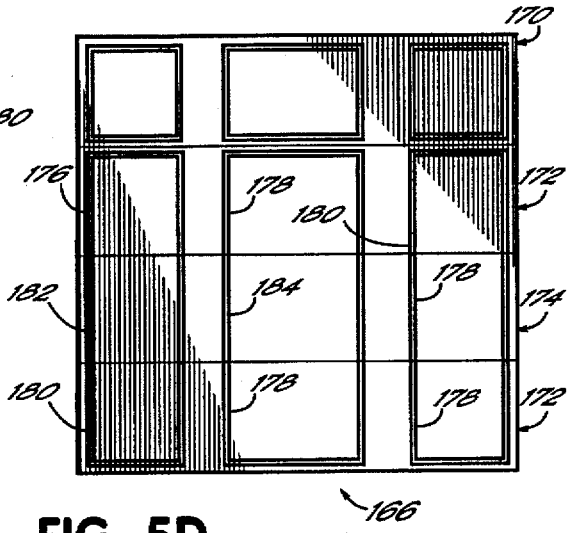
Figure 5E:
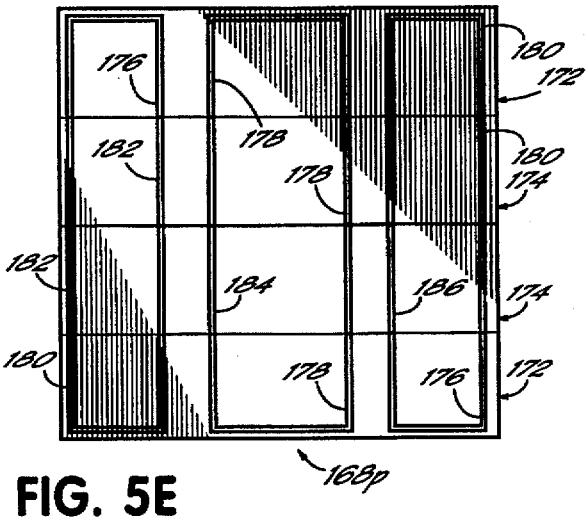

FIG. 5A–5E illustrate five different door configurations 160, 162, 164, 166, 168 which may be constructed in accordance with the present invention using three base panel designs 170, 172, 174 with different overall door designs being created by flipping panels with respect to each other. Although only five different door designs are shown, in theory, 256 different door designs could be constructed using four panels. Each of panels 170, 172, 174 may be utilized with either longitudinal edge serving as a relative upper or lower edge of the panel within the overall door construction. The unique ability to create doors 160, 162, 164, 166, 168 having differently configured and aligned front door designs resides in flipping or turning around a panel with respect to another panel such that the lower edge thereof becomes the upper edge and vice versa. For example, it will appreciated from a review of FIGS. 5A–5E that panel 172 is used in both of its two possible orientations with design elements 176, 178, 180, generally in the form of open ended boxes, being oriented either upwardly or downwardly to align with each other or, for example, to align with design elements 182, 184, 186 of panel 174 as shown in FIGS. 5C–5E. In other words, the ability to flip or turn a panel, such as panel 172, allows the design elements on the left of that panel to become design elements on the right of the panel and vice versa to potentially create a wide variety of different overall door front design configurations in the manner exemplified in FIG. 5A–5E while necessitating the manufacture and stocking of a more limited number of panel design styles.

It will be appreciated that certain panels, such as panel 174, may be provided having design elements which are symmetrical about a longitudinal centerline of the panel (see elements 182, 184, 186). These panels will have the same design pattern or "aesthetic look" whether the panel is "flipped" or not. In accordance with the present invention, however, panels having design elements which are not symmetrical about a longitudinal centerline of the panel, (see elements 176, 178, 180 of panel 172), are provided which will create a different design pattern or aesthetic look in each of two possible orientations. Also, in each orientation, the design elements will align with design elements of an adjacent panel to create a different overall look or design pattern for the door.

Figure 6A:
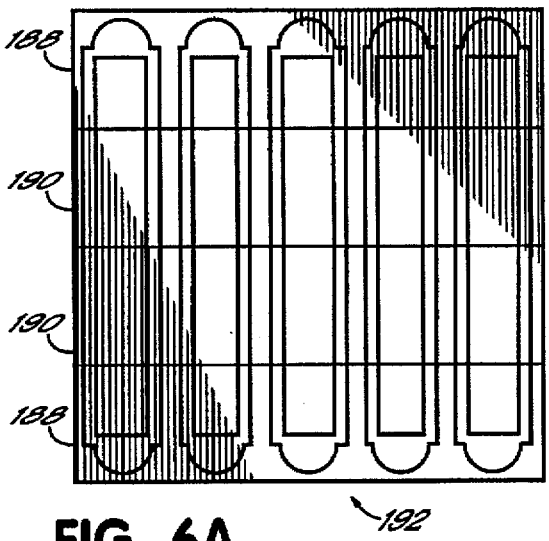
Figure 6B:
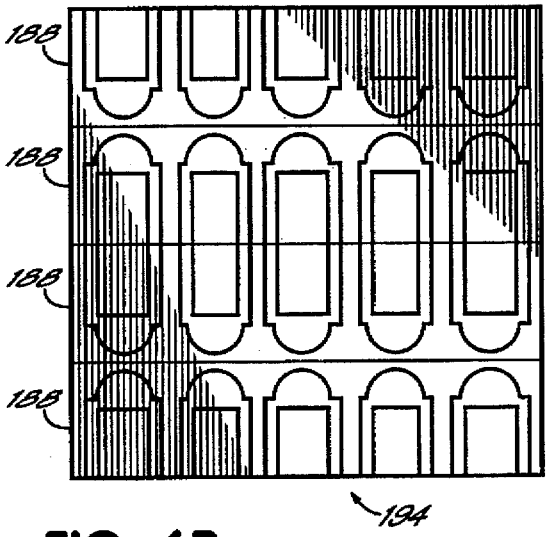
Figure 6C:
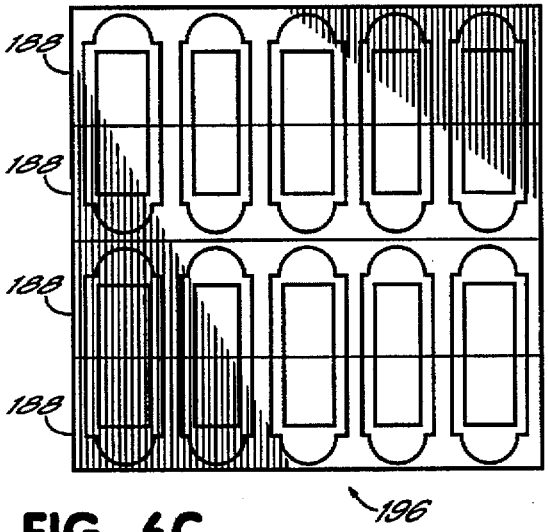

FIGS. 6A–6C illustrate essentially the same concept illustrated in FIGS. 5A–5E except that a different front panel and door design configuration is shown. In FIGS. 6A–6C two different panel types 188, 190 are used to construct three different door configurations 192, 194, 196 and one panel type 188 may be used to construct two different door configurations 194, 196 as illustrated in FIGS. 6B and 6C, each being accomplished by flipping or turning around panel 188 such that each of its longitudinal edges may function as either an upper edge or a lower edge of panel 188 regardless of the particular door configuration.

While preferred embodiments of the present invention has been detailed above, it will be understood that many modifications and substitutions for the specifically described embodiments may be made without departing from the spirit and scope of the invention. Applicants therefore do not intend to be bound by the details provided herein but only by the scope of the appended claims.

What is claimed is:

1. A modular sectional door comprising:

a plurality of door panels, each door panel including upper and lower longitudinal and generally horizontal edges and a front face having three dimensional design elements thereon, wherein the design elements of at least two adjacent door panels cooperate to form a continuous first design pattern; and, joints joining adjacent door panels of said door and, each joint including a hinge affixed along a rear side of said door and an intermediate elongate member having a curved front surface and presenting said curved surface when two adjacent door panels are pivoted with respect to each other, wherein said joints are formed by connecting structure allowing each panel to be flipped about an axis orthogonal to its front face so that the upper edge of the flipped panel becomes the lower edge and vice versa the flipped panel cooperate with the design elements of an adjacent panel to form a second design pattern which is different than the first design pattern.

2. The modular sectional door of claim 1 wherein at least first and second panels are identical in construction and have identical design elements on the front face, said design elements being asymmetrical about a longitudinal centerline of each of said first and second panels, and wherein said first and second panels are connected in opposite orientations as part of said door.

3. The modular sectional door of claim 1 wherein each panel includes identical female joint structure extending along each longitudinal edge thereof and identical male joint members connect adjacent panels together by being received in adjacent female joint structure of said adjacent panels.

4. The modular sectional door of claim 3 wherein said male joint members are generally "D"-shaped in cross section.

5. The modular sectional door of claim 4 wherein said male joint members receive roller supports.

6. The modular sectional door of claim 3 wherein said male joint member includes two continuously curving bearing surfaces separated by a central, outwardly extending rib.

7. The modular sectional door of claim 6 wherein said rib is formed from a resilient material.

8. The modular sectional door of claim 3 wherein the female joint structures of each panel include a cavity which carries a reinforcing strut.

9. The modular sectional door of claim 8 wherein each panel is formed from a foam core sandwiched between inner and outer skins.

10. The modular sectional door of claim 3 wherein each hinge includes two halves separated by a hinge line, one half being connected to each female joint structure of two adjacent panels.

11. The modular sectional door of claim 10 wherein each hinge further comprises an elongate flexible member and said two halves are retained within recesses of the female joint structures of two adjacent panels.

12. The modular sectional door of claim 3 further comprising an astragal having a male connecting member mating with one of said female joint member structures at a lower edge of the door.

13. The modular sectional door of claim 1 wherein said door is an overhead door and said panels are connected together along longitudinal horizontal edges thereof.

14. A modular sectional door comprising:

a plurality of door panels, each door panel including upper and lower longitudinal and generally horizontal edges and a front face having three dimensional design elements thereon, wherein a first panel includes design elements which are asymmetrical about a longitudinal center line of said first panel such that a first continuous design pattern is presented when said first panel is oriented one way to cooperate with the design elements of an adjacent panel and a second, different design pattern is presented when said first panel is flipped about an axis orthogonal to its front face such that the upper edge of the first panel becomes the lower edge and vice versa, wherein said design elements of said first panel align with the design elements of said adjacent second panel to form the first and second design patterns; and joint connecting structure affixed along the longitudinal edges of said first and second panels for allowing said first panel to be flipped and connected to said second panel with said second panel remaining in one orientation such that said first and second design patterns may be presented as between said first panel and said second panel, the joint connecting structure including a hinge affixed along a rear side of said door and an intermediate elongate member having a curved front surface presented along a front side of said door when said first and second door panels are pivoted with respect to each other.

15. The modular sectional door of claim 14 wherein said first and second panels include identical female joint structure extending along each longitudinal edge thereof and said intermediate elongate member is a male joint member connecting said first and second panels together by being received in adjacent female joint structure of said first and second panels.

16. The modular sectional door of claim 15 wherein said male joint member is generally "D"-shaped in cross section.

17. The modular sectional door of claim 16 wherein said male joint member receives a roller support.

18. The modular sectional door of claim 15 wherein said male joint member includes two continuously curving bearing surfaces separated by a central, outwardly extending rib.

19. The modular sectional door of claim 18 wherein said rib is formed from a resilient material.

20. The modular sectional door of claim 15 wherein the female joint structures of each panel include a cavity which carries a reinforcing strut.

21. The modular sectional door of claim 20 wherein each panel is formed from a foam core sandwiched between inner and outer skins.

* * * * *

UNITED STATES PATENT AND TRADEMARK OFFICE

CERTIFICATE OF CORRECTION

PATENT NO. : 5,709,259

DATED : January 20, 1998

INVENTOR(S) : Richard J. Lewis, et al.

It is certified that error appears in the above-indentified patent and that said Letters Patent is hereby corrected as shown below:

| | | |
|---|---|---|
| Column 8, line 8, | after "vice versa", | insert --such that the design elements on-- |
| Column 8, line 50 | | delete the word "member" |

Signed and Sealed this

Twenty-sixth Day of May, 1998

*Attest:*

*Attesting Officer*

BRUCE LEHMAN

*Commissioner of Patents and Trademarks*